United States Patent [19]

Poole et al.

[11] Patent Number: 4,931,111

[45] Date of Patent: Jun. 5, 1990

[54] AZIDE GAS GENERATING COMPOSITION FOR INFLATABLE DEVICES

[75] Inventors: Donald R. Poole, Woodinville; Michael A. Wilson, Bothell, both of Wash.

[73] Assignee: Automotive Systems Laboratory, Inc., Farmington Hills, Mich.

[21] Appl. No.: 432,150

[22] Filed: Nov. 6, 1989

[51] Int. Cl.[5] ..... C06G 35/00

[52] U.S. Cl. ..... 149/35; 149/61; 149/77; 200/741

[58] Field of Search ..... 149/35, 61, 77; 280/741

[56] References Cited

U.S. PATENT DOCUMENTS

| | | | |
|---|---|---|---|
| 3,996,079 | 12/1976 | DiValentin | 149/35 |
| 4,376,002 | 3/1983 | Utracki | 149/35 |
| 4,533,716 | 8/1985 | Poole | 149/35 |
| 4,547,235 | 10/1985 | Schneiter et al. | 149/35 |
| 4,696,705 | 9/1987 | Hamilton | 149/21 |
| 4,758,287 | 7/1988 | Pietz | 149/35 |

*Primary Examiner*—Stephen J. Lechert, Jr.
*Attorney, Agent, or Firm*—Lyon & Delevie

[57] ABSTRACT

Gas generating compositions containing an inorganic metal azide, a primary metal oxide oxidizing compound and a secondary oxidizing compound in combination with clay as a means of controlling the burn rate. Metal nitrates are preferred as the secondary oxidizing compound.

7 Claims, No Drawings

AZIDE GAS GENERATING COMPOSITION FOR INFLATABLE DEVICES

BACKGROUND OF THE INVENTION

1. Field of the Invention

This invention relates to a chemical gas generating composition in solid, pelletized form, which is capable, upon ignition, of rapidly producing large volumes of non-toxic gases. The gas generating composition of the invention is particularly adapted for inflating safety crash bags in passive restraint systems for passenger vehicles.

2. Description of the Prior Art

The use of protective gas inflated bags to cushion vehicle occupants in a crash situation is now widely known and well documented. In the early systems of this type, compressed, stored gas is used to inflate a crash bag which is situated between the occupant and the windshield, steering wheel, and dashboard of the vehicle. Upon rapid deceleration of the vehicle, gas is released through a quick acting valve to inflate the crash bag. Stored, pressurized gas systems have now been largely superceded by systems which utilize gases generated by the ignition of a chemical gas generating pyrotechnics substance. In such a system, an ignition means, such as an electrically activated squib associated with a suitable sensing means, is used to ignite the gas generating composition.

Because of the recent strict requirements for non-toxic inflating gases, most, if not all, of the gas generating compositions now in use are based on inorganic azides. Early azide compositions did not address the toxicity problem of the gases generated since it was not envisioned at that time that the gases generated should be breathable. Gas generating compositions which will provide non-toxic gases or those which will burn at a high burn rate are easy to prepare, but it is difficult to meet the requirements of rapid burn rate and non-toxic gas generation in a single gas generating composition.

Metal oxides as coreactants for an inorganic metal azide have been used to produce non-toxic nitrogen gas for inflating crash bags. In the reaction with the inorganic azide, the metal oxide provides the oxygen for conversion of the inorganic metal in the azide to an oxide. The metal oxide additionally reacts to form a sintered, coherent combustion residue which is easy to filter. However, the use of metal oxides as coreactants for inorganic azides present several problems, one of which is that such mixtures are generally slow burning, difficult to form into pellets, and often cause rapid wear of punches, dies, and other parts of automatic pelletizing machines.

The formation of a gas generating particulate composition into pellets has generally been found to provide uniformly burning propellants, which are necessary for proper inflation of the restraint device. When metal oxides are used as coreactants for inorganic azides in gas generating compositions, the pellets of the composition must be made very small or very thin to provide sufficient surface area to obtain a reasonable rate of combustion. Such pellets are difficult to produce and are subject to more breakage than larger pellets. While the addition to the gas generating composition of more effective oxidizer compounds, such as the alkali metal perchlorates or alkali metal nitrates, can be used to increase the combustion rate of metal oxide/inorganic azide gas generating compositions, these oxidizer compounds increase the combustion temperature so that the compositions, upon combustion, provide residues which cause filtration problems.

Many quick-burning gas generating compositions have been proposed in the prior art for crash bag inflation purposes. It is desirable to develop a gas generating composition combining the features of short induction period, a rapid burn rate, a high bulk density and the production of only non-toxic gases. In addition, good filterability of the reaction products is desirable so that the hot, solid residue cinders of the reaction of the pyrotechnic substance can be easily removed from the gas stream.

In U.S. Pat. No. 4,376,002 to Utracki, improved burn rate pyrotechnic compositions, suitable for inflating a gas bag, are disclosed in which a synergistic primary oxidant component, such as iron oxide, is utilized with an alkali metal or alkaline earth metal azide in combination with a residue control agent consisting of at least one of the oxides of titanium, aluminum, and zinc.

In U.S. Pat. No. 4,547,235, rapid burn rate pyrotechnic compositions suitable for inflation of a crash bag are disclosed utilizing sodium azide as the nitrogen source and wherein silicon dioxide and potassium nitrate are utilized in combination therewith to provide a gas generating composition having a rapid burn rate.

In U.S. Pat. No. 3,996,079 to DiValentin, pyrotechnic gas generating, granular compositions, suitable for inflating an air bag of an automobile passive restraint system, are disclosed in which an alkali metal or alkaline earth metal azide is utilized in combination with nickel oxide or iron oxide and a minor amount (0.5% to 3.0%) of clay. The clay is disclosed as needed to improve the extrusion characteristics, the burning profile, mechanical strength and packing density of the granular compositions. The gas generating compositions react at a relatively low temperature and the solid products of the reaction form a sinter which is readily retained by a filter. There is no indication that the addition of clay provides any effect upon the burning rate of the pyrotechnic composition.

In 3 U.S. Pat. No. 4,696,705 to Hamilton, a pyrotechnic gas generating composition is disclosed in which 0 to 5 percent by weight of bentonite clay is utilized. The pyrotechnic composition is disclosed as a coated grain having a coating weight of 1 to 4 percent of the total weight of the grain prior to coating. There is no indication that the use of bentonite provides any advantages in the composition.

SUMMARY OF THE INVENTION

The gas generating composition of this invention comprises (a) an inorganic metal azide, preferably an alkali metal or alkaline earth metal azide in a proportion of about 50 to about 70 percent by weight; (b) a primary metal oxide oxidizing compound in a proportion of about 2 to about 30 percent by weight; and (c) about 2 to about 40 percent by weight of a burn rate controlling mixture of a secondary oxidizing compound and clay, wherein the ratio of said secondary burn rate controlling oxidizing compound to clay is generally about 1:1 to about 1:8 in proportion by weight.

DETAILED DESCRIPTION OF THE PREFERRED EMBODIMENTS OF THE INVENTION

The use of clay in combination with a secondary oxidizing, burn rate controlling amount of an inorganic nitrate has been found to overcome certain problems caused in inorganic metal azide gas generating, pelletized, particulate compositions utilizing a metal oxide as a primary oxidizing compound. In addition to increasing the rate of burn of the pyrotechnic composition, the use of a small amount of clay in the pyrotechnic composition significantly reduces the friction resulting upon the removal of the pyrotechnic composition pellets from dies subsequent to compression molding. Thus, the quality of the pellets is improved. It was completely unexpected to find that the use of clay in the pyrotechnic composition in conjunction with the use of an inorganic nitrate as a secondary oxidizing compound also provides an increase in the burning rate. Since clay is essentially aluminum silicate with minor amounts of iron, magnesium, sodium, and calcium silicates, and since aluminum silicate can be formed by interaction of aluminum oxide and silicon dioxide, it might be expected that clay would react with hot sodium oxide and thereby participate in solid residue (clinker) formation. In fact, more readily filterable solids are obtained in use of the gas generating compositions of the invention.

The use of a mixture of a secondary oxidizing compound, i.e., a metal nitrate or metal perchlorate, and clay as ingredients of the pyrotechnic composition of the invention provide a means of substantially increasing the burning rate of inorganic metal azides and metal oxide primary oxidizing compounds. While compositions of the invention show some increase in the burning rate without the addition of a secondary oxidizing compound, a large increase in burning rate can be obtained by the use of a combination of clay and a small amount of a metal nitrate oxidizer compound.

In evaluating the burning rate of pyrotechnic compositions for generating gas, samples of the blended pyrotechnic powder composition are compression molded in a 0.5 inch diameter die at a pressure of approximately 81,000 psi to form cylinders approximately 0.5 inch long. The sides of the cylinders are inhibited from burning by means of an epoxy-titanium dioxide mixture coating. These cylinders are tested for burning rate by igniting one end of the cylinder in a closed vessel pressurized with gaseous nitrogen. The burning rate of the pyrotechnic composition gas generating composition is the time required to burn the entire length of the cylinder. Usually each test involves burning three to six cylinders to arrive at an average burn rate.

The pyrotechnic composition of the invention can be ignited by means of a hot wire or a squib. Generally, as is well known in the art, the gas generating composition can be enclosed in a vessel that communicates with the inflatable bag of the restraint system. Normally a baffle and/or filtering device will be positioned in a gas duct between the gas generating vessel and the inflatable bag for the purpose of restricting the flow of solid products into the bag.

Suitable inorganic metal azide ingredients of the gas generating compositions of this invention generally consist of at least one of an alkali metal or alkaline earth metal azide, preferably, at least one of lithium azide, sodium azide, potassium azide, rubidium azide, cesium azide, calcium azide, magnesium azide, strontium azide, and barium azide. Most preferably, sodium azide is utilized.

Suitable primary metal oxide oxidizing compounds generally can be selected from at least one of the oxides of iron, silicon, manganese, aluminum, tantalum, niobium, tin, and nickel. Preferably, the oxides of iron and nickel are utilized.

The secondary metal oxidizing compounds for use in combination with the clay generally can be selected from (1) at least one of the metal nitrates of lithium, sodium, potassium, magnesium, calcium, barium and aluminum and/or (2) at least one of the metal perchlorates of lithium, sodium, potassium, calcium, and barium. The metal nitrates are preferred and most preferably, potassium nitrate is utilized.

Various sources of clay can be utilized in combination with a secondary oxidizing compound to provide an increase in the burning rate of the pyrotechnic compositions of the invention. Generally any clay can be used. Preferred are those clays consisting of aluminum and/or magnesium silicate with minor amounts of iron, magnesium, sodium, and calcium silicates. Most preferably, bentonite clay is utilized.

The combination of the preferred secondary oxidizing compound metal nitrate and the clay is used in a proportion of about 2 to about 40 percent by weight, preferably about 5 to about 30 percent, and most preferably, about 10 to about 25 percent by weight. Generally, the weight proportion of the metal nitrate to the clay is about 1:1 to about 1:8, preferably about 1:1 to 1:6, and most preferably, about 1:2 to 1:5. The primary metal oxide oxidizing compound is utilized in the gas generating pyrotechnic compositions of the invention in an amount of about 2 to about 30 weight percent. Preferably, about 8 to about 28 percent, and most preferably about 10 to 25 percent by weight of primary metal oxide oxidizing compound is used.

Those skilled in the art will realize that additional oxidizing compounds can be utilized in the compositions of the invention instead of the metal nitrates and metal perchlorates to provide the same or additional advantages. Oxidizing compounds which may be suitable as secondary oxidizing compounds of the gas generating compositions of the invention include metal peroxides such as sodium peroxide, and potassium peroxide.

The following Examples illustrate the various aspects of the invention. Where not otherwise specified throughout this specification and claims, temperatures are given in degrees centigrade and parts, percentages, and proportions are by weight.

Gas generating compositions were prepared in the following Examples by drying the ingredients, in percent by weight, as listed in the Table below, at 110° C., prior to weighing out the proper proportions and mixing the components thoroughly. Thereafter, the compositions of the Examples were compression molded in a 0.5 inch diameter die at a pressure of approximately 81,000 psi in order to form cylinders approximately 0.5 inch long. Burn rate evaluation is accomplished by determining the time required to burn the cylinder subsequent to ignition in a closed vessel pressurized with gaseous nitrogen. The results shown for burn rate in inches per second is the average of the time required to burn 3–6 cylinders representing each composition.

EXAMPLE 1

(control, forming no part of this invention)

The following gas generating composition in percent by weight was prepared: sodium azide 62; graphite 0.5; potassium nitrate 4.36; ferric oxide 33.14. When tested for burn rate, as described above, the rate was 0.78 inches/sec.

EXAMPLES 2-8

Gas generating compositions 2-6, illustrating the invention, were prepared. Examples 7 and 8 are controls.

TABLE I

| Example | $NaN_3$ | Graphite | $KNO_3$ | $Fe_2O_3$ | Clay* | Burn Rate (in/sec) |
|---|---|---|---|---|---|---|
| 2 | 62.00 | 0.50 | 4.36 | 28.14 | 5.00 | 0.95 |
| 3 | 62.00 | 0.50 | 4.36 | 23.14 | 10.00 | 1.10 |
| 4 | 62.00 | 0.50 | 4.36 | 18.14 | 15.00 | 1.19 |
| 5 | 62.00 | 0.50 | 4.36 | 13.14 | 20.00 | 1.15 |
| 6 | 62.00 | 0.50 | 4.36 | 8.14 | 25.00 | 0.98 |
| 7 | 62.00 | 0.50 | 4.36 | 3.14 | 30.00 | 0.64 |
| 8 | 62.00 | 0.50 | 4.36 | None | 33.14 | 0.45 |

*Bentonite clay sold under the tradename Volclay HPM-20.

In U.S. Pat. No. 4,376,002 to Utracki, gas generant compositions are disclosed containing iron and silicon oxides with and without aluminum oxide. For Examples 9-14, gas generant compositions were made using various combinations of silicon and aluminum oxides in place of clay. These examples, and, in particular, Example 11 in which the mixture of aluminum and silicon dioxides simulates the elemental composition of clay, demonstrate, that the use of clay in the gas generant compositions of the invention yields a unique advantage in ignitability and burn rate.

EXAMPLE 9

(control, forming no part of this invention)

A gas generant composition was prepared with components similar in composition to Example 5, except that silicon dioxide was substituted for the bentonite clay. When cylinders were prepared and tested as described above, the average measured burn rate was found to be 0.32 inches per second. The average density was 2.08 grams per cubic centimeter.

EXAMPLE 10

(control, forming no part of this invention)

A gas generant composition was prepared similar in composition and proportions to Example 5, except that an equal percent by weight of aluminum oxide was substituted for the clay. When the cylinders, prepared as described above, were evaluated for burn rate, the average burn rate was found to be 0.62 inches per second. The average density was found to be 2.06 grams per cubic centimeter.

EXAMPLE 11

(control, forming no part of this invention)

A gas generant composition was prepared having similar components and proportions to Example 5 except that a mixture of silicon dioxide in the amount of 15% by weight and aluminum oxide in the amount of 5% by weight was substituted for the clay in Example 5. When the cylinders prepared from this composition were tested as described above, it was found that the average measured burn rate was 0.44 inches per second. The average density of the composition was 2.02 grams per cubic centimeter.

EXAMPLES 12-14

(controls, forming no part of this invention)

Examples 12-14 were prepared of gas generant compositions, as described in the Table below (all proportions are percent by weight). These Examples show that unless an additional (secondary) oxidizer compound is present in the gas generant composition, that the simple substitution of clay for part of the usual amount of iron oxide required for complete reaction with the sodium azide does not produce as large an increase in burn rate, as compared to Examples 2-6.

TABLE II

| Example | $NaN_3$ | $Fe_2O_3$ | Clay* | Average Burn Rate (in/sec) |
|---|---|---|---|---|
| 12 | 62.00 | 38.00 | — | 0.36 |
| 13 | 62.00 | 33.00 | 5.00 | 0.35 |
| 14 | 62.00 | 23.00 | 15.00 | 0.45 |

*Bentonite clay sold under the tradename Volclay HPM-20.

EXAMPLE 15

A gas generant composition was prepared having similar components and proportions to Example 2 except that a type of clay designated by the tradename Magnabrite F was substituted for the Volclay HPM-20. When cylinders prepared from this composition were tested, as described above, it was found that the average measured burn rate was 0.90 inches per second. The average density of the composition was 2.06 grams per cubic centimeter. This Example demonstrates the use of a different type of clay, Magnabrite F, which is a blend of white smectite clays and is primarily composed of magnesium aluminum silicate.

EXAMPLES 16-20

Examples 16-20 were prepared of gas generant compositions, as described in the Table below (all proportions are percent by weight). These Examples demonstrate the effect of increasing amounts of secondary oxidizer compound (exemplified by potassium nitrate) on gas generant burn rate.

TABLE III

| Example | $NaN_3$ | Graphite | $KNO_3$ | $Fe_2O_3$ | Clay* | Burn Rate (in/sec) |
|---|---|---|---|---|---|---|
| 16 | 62.00 | 0.50 | 1.86 | 20.64 | 15.00 | 0.71 |
| 17 | 62.00 | 0.50 | 3.00 | 19.50 | 15.00 | 0.90 |
| 18 | 62.00 | 0.50 | 4.36 | 18.14 | 15.00 | 1.19 |
| 19 | 62.00 | 0.50 | 5.50 | 17.00 | 15.00 | 1.19 |
| 20 | 62.00 | 0.50 | 7.00 | 15.50 | 15.00 | 1.02 |

*Bentonite clay sold under the tradename Volclay HPM-20.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

We claim:

1. An increased burn rate gas generating composition comprising a mixture of:

(a) about 50 to about 70 percent by weight of an inorganic metal azide, (b) about 2 to about 30 percent by weight of a primary metal oxide oxidizing compound, and (c) about 2 to about 40 percent by weight of a burn rate controlling mixture of a secondary metal oxidizing compound and clay wherein the weight ratio of said secondary oxidizing compound to said clay is about 1:1 to about 1:8.

2. The gas generating mixture of claim 1 wherein said inorganic metal azide is selected from at least one of an alkali metal azide and an alkaline earth metal azide and said secondary oxidizing compound is a metal nitrate or metal perchlorate.

3. The gas generating mixture of claim 2 wherein said primary metal oxide oxidizing compound is selected from the group consisting of at least one of the oxides of iron, nickel, silicon, manganese, aluminum, tantalum, niobium, and tin.

4. The gas generating mixture of claim 3 wherein said secondary oxidizing compound is selected from the group consisting of at least one of the nitrates of lithium, sodium, potassium, magnesium, calcium, strontium, and barium or the perchlorates of lithium, sodium, potassium, and barium.

5. The gas generating composition of claim 4 wherein said alkali metal azide is sodium azide, said primary metal oxide oxidizing compound is ferric oxide, said secondary metal nitrate oxidizing compound is potassium nitrate, and said clay is a bentonite clay.

6. A method of inflating an automobile or aircraft safety crash bag comprising the combustion of a pyrotechnic material at an increased burn rate with the production of only non-toxic gases, wherein an increased burn rate is obtained by utilizing a mixture of particles comprising:

(a) about 50 to about 70 percent by weight of an inorganic metal azide, (b) about 2 to about 30 percent by weight of a primary metal oxide oxidizing compound, and (c) about 2 to about 40 percent by weight of a burn rate controlling mixture of a secondary metal oxidizing compound and clay, wherein the ratio of said secondary metal oxidizing compound to clay is about 1:1 to about 1:8.

7. The process of claim 6 wherein said increased burn rate is obtained utilizing a pelletized mixture wherein said inorganic azide is selected from the group consisting of at least one of an alkali metal azide and an alkaline earth metal azide, said primary metal oxidizing compound is iron oxide, said secondary metal oxidizing compound is potassium nitrate, and said clay is bentonite clay.

* * * * *